US005435765A

United States Patent [19]

Fletcher

[11] Patent Number: 5,435,765

[45] Date of Patent: Jul. 25, 1995

[54] SURFBOARD PAD

[76] Inventor: Herbert E. Fletcher, P.O. Box 4296, San Clemente, Calif. 92674

[21] Appl. No.: 298,560

[22] Filed: Aug. 30, 1994

[51] Int. Cl.[6] ..... B63B 35/79

[52] U.S. Cl. ..... 441/74; 4/583

[58] Field of Search ..... 441/65, 67, 68, 74, 441/75; 4/583

[56] References Cited

U.S. PATENT DOCUMENTS 3,999,224 12/1976 Kollsman ..... 4/583
5,308,271 5/1994 Foulke ..... 441/74

OTHER PUBLICATIONS

Astrodeck "Killer Winter Combos" (single page flyer).
Astrodeck "Te All New Astrodeck Grip This!" (single page flyer).
Astrodeck 1994 Catalog.

*Primary Examiner*—Jesus D. Sotelo
*Attorney, Agent, or Firm*—Spensley Horn Jubas & Lubitz

[57] ABSTRACT

A non-slip padding system for use on a surfboard has a plurality of pad members each having a top surface, a bottom surface, a first end, a second end and raised elements. The raised elements include a first raised member and a second raised member, wherein the first raised member extends from the top surface of the pad member and the second raised member extends from the top surface of the first raised member.

8 Claims, 5 Drawing Sheets

SURFBOARD PAD

FIELD OF THE INVENTION

This invention relates to an improved surfboard padding that minimizes slippage between a person's foot and a surfboard.

BACKGROUND OF THE INVENTION

Surfing is a popular sport that requires balance, coordination and dexterity. Board control is accomplished by proper foot placement and weight shifting. It is axiomatic that the surfer be able to freely maneuver his or her feet on the board without inadvertently slipping. Therefore, it is desirable to have suitable friction contact between the surfer's feet and the board to inhibit inadvertent slipping and to provide the surfer with confidence that his or her feet will not easily slip along the upper surface of the board as the surfer maneuvers his or her feet and shifts his or her weight. Many surfers utilize a friction enhancement that increases friction and allows the user's feet to grip the surfboard.

One type of friction enhancement aid is surfboard wax. Surfboard wax is applied to the upper surface of the surfboard prior to use and must be reapplied periodically. Applying wax can be physically strenuous and time-consuming. Moreover, because wax tends to melt and rub off, periodic reapplications are required.

Another type of friction enhancement is a non-slip pad. Non-slip pads have been developed by the present inventor to be directly applied to the board by means of an adhesive backing. The surface of the pad is either smooth or has a simple, single level contour.

Although various non-slip pads are currently in use, surfers seem to be constantly attempting to find ways to improve their foot-to-board grip.

SUMMARY OF THE DISCLOSURE

An object of this invention is to provide improved traction between a surfer's foot and a surfboard. A further object of this invention is to increase the ability of the surfer to control a surfboard.

Preferred embodiments of the present invention comprise a traction pad system having a multi-part structure. The multipart structure of the traction pad system further comprises multiple pad members, each pad member having a top surface, a bottom surface and raised elements extending from the top surface. The bottom surface of each pad member has an adhesive coating that readily adheres to the upper surface (or deck) of the surfboard. The multiple pad members may be adhered to the upper surface of the surfboard in a spaced-apart relation.

In other preferred embodiments, the traction pad system comprises a contiguous structure composed of a single pad member. The single pad member is provided with raised elements and adhesive as discussed above with respect to the multi-part system. Further preferred embodiments include a logo or an emblem (such as a company logo, name or trademark and/or a stylistic design or message) disposed on the top surface of at least one of the pad members.

BRIEF DESCRIPTION OF THE DRAWINGS

The detailed description of the embodiments of the invention will be made with reference to the accompanying drawings, wherein like numerals designate corresponding parts in the several figures.

DETAILED DESCRIPTION OF THE PREFERRED EMBODIMENTS

Figure 1:
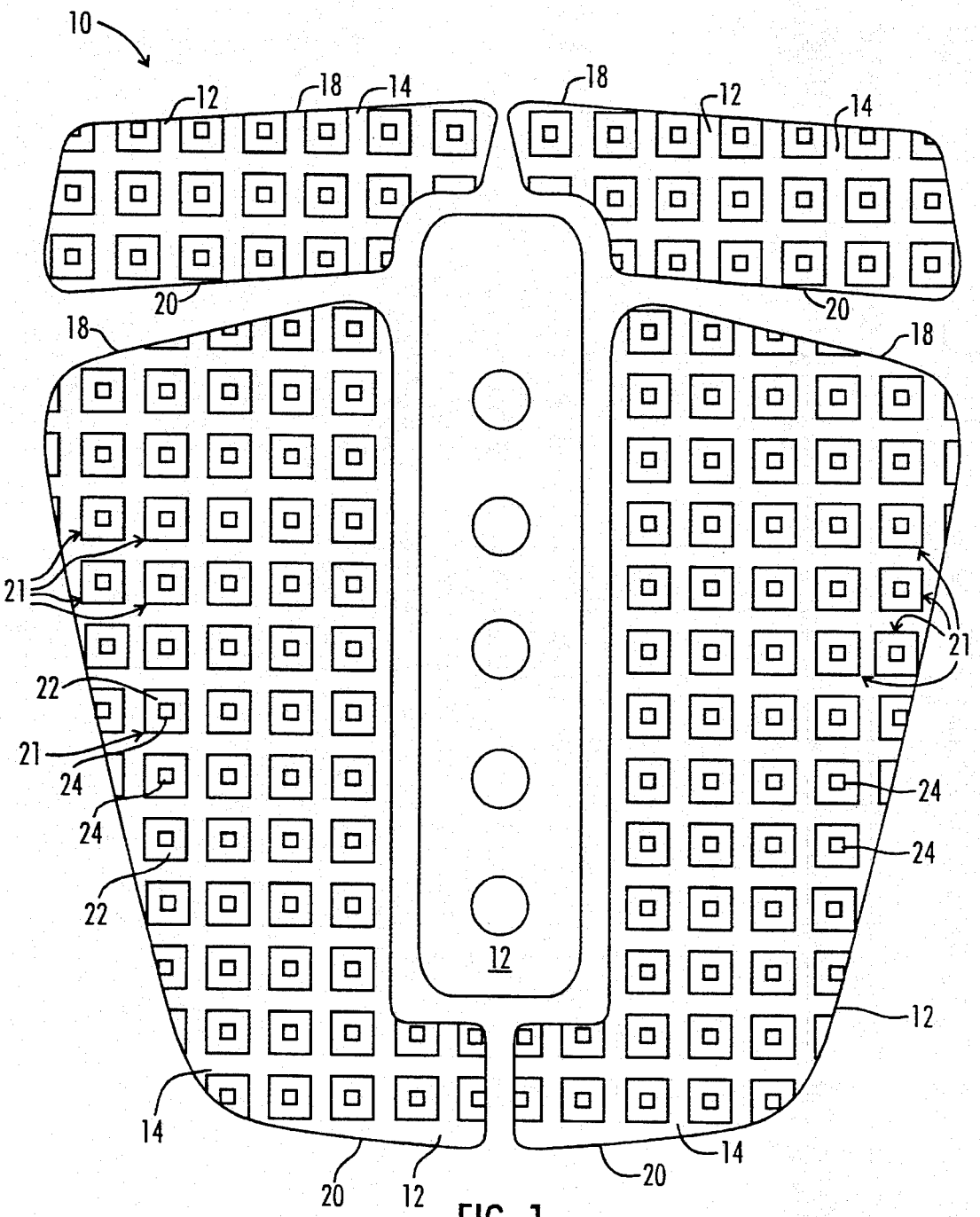
FIG. 1 is a top view of surfboard padding system according to a preferred embodiment of the present invention.
Figure 6:
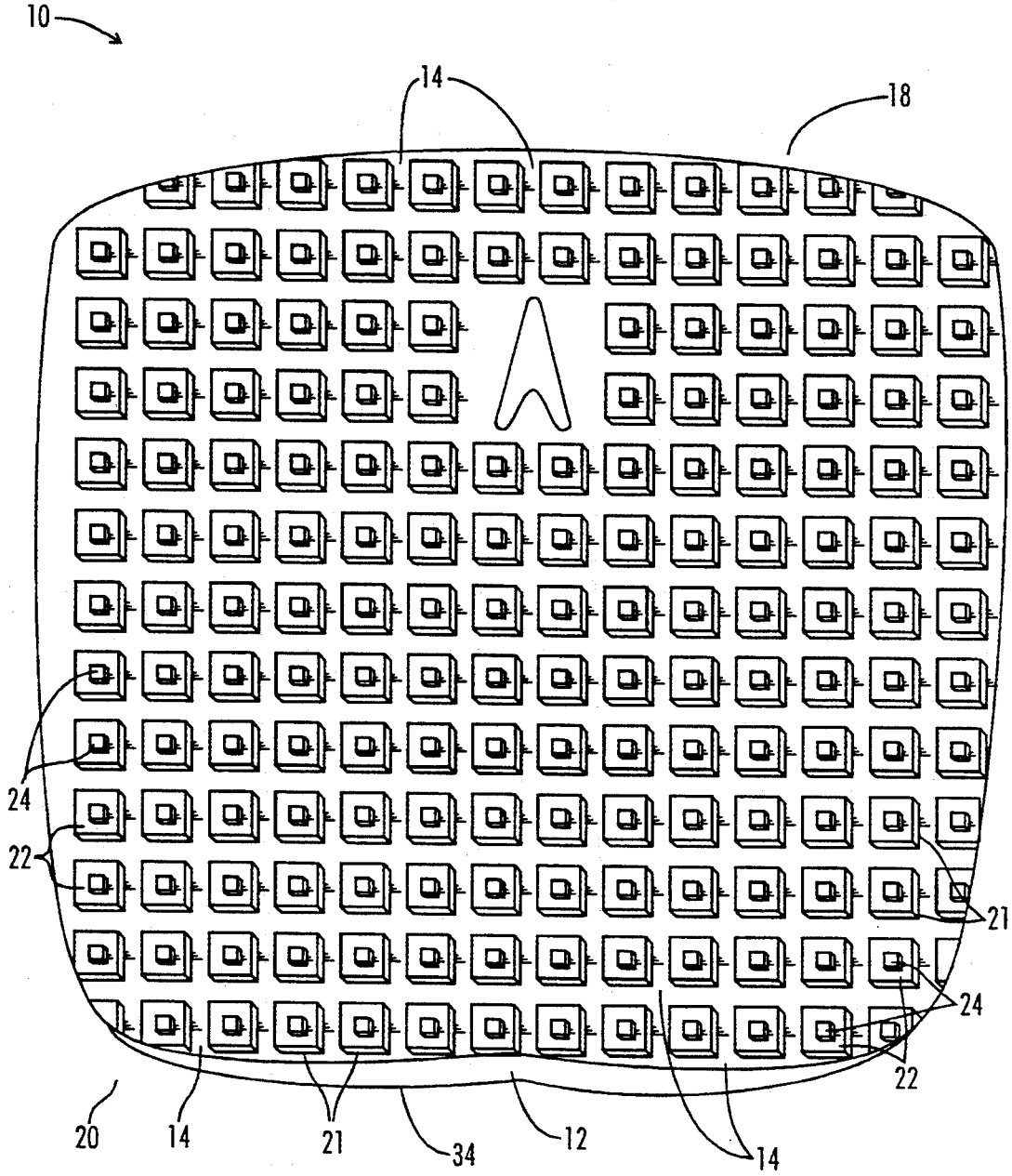
FIG. 6 is top of a surfboard pad with a one-piece contiguous construction according to a preferred embodiment of the invention.

FIG. 1 is a top view of a multi-piece surfboard padding system 10 according to a preferred embodiment of the present invention. Generally, the surfboard padding system 10 shown in FIG. 1 comprises multiple pad members 12. Each of the pad members 12 has a substrate 13 defining a top surface 14, a bottom surface 16 (FIG. 3), a forward directed end 18 and a rearward directed end 20. A plurality of raised elements 21 extend from the top surface 14 of the pad member substrate 13. In other preferred embodiments, the padding system 10 is a contiguous structure comprising a single pad member 12 of suitable shape and contour. Yet other embodiments employ any suitable number and shaped pad members 12. (See, for example, FIG. 6.)

The pad members 12 are preferably made from, but not limited to, soft, rubbery or flexible material with sufficient durability and water resistance or compatibility to withstand prolonged exposure to seawater. Suitable materials include, but are not limited to, foam rubber or soft polyurethane. Alternatively, other suitable materials suitable to prevent slippage on the surface of the surfboard by a user's foot can also be utilized.

Figure 2:
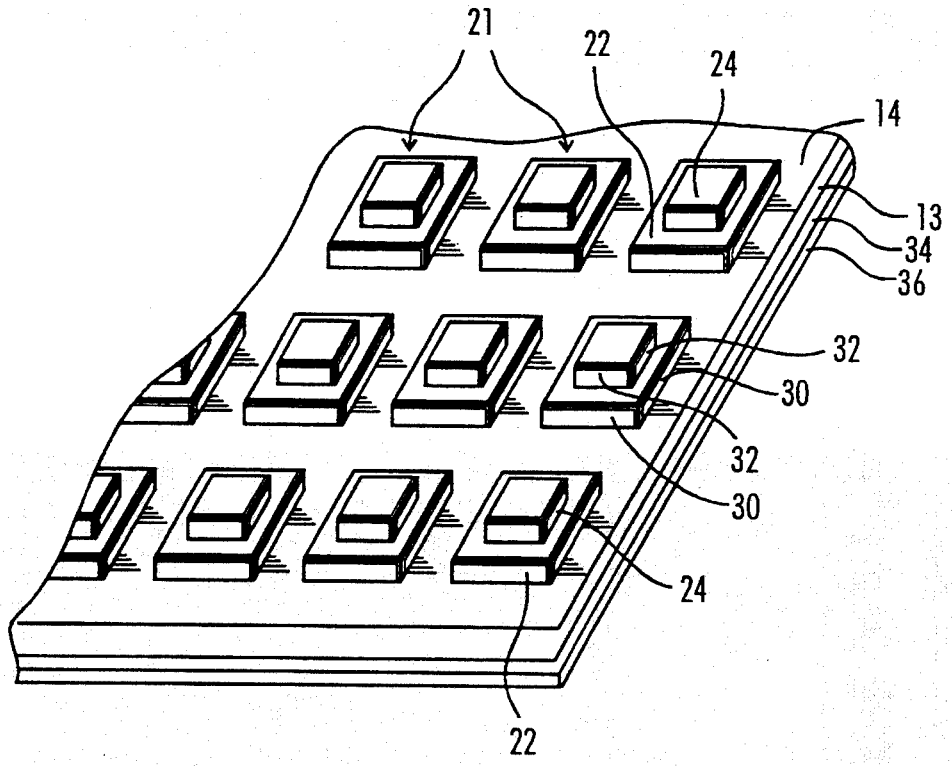
FIG. 2 is a perspective view of a portion of surfboard padding according to a preferred embodiment of the invention.
Figure 3:
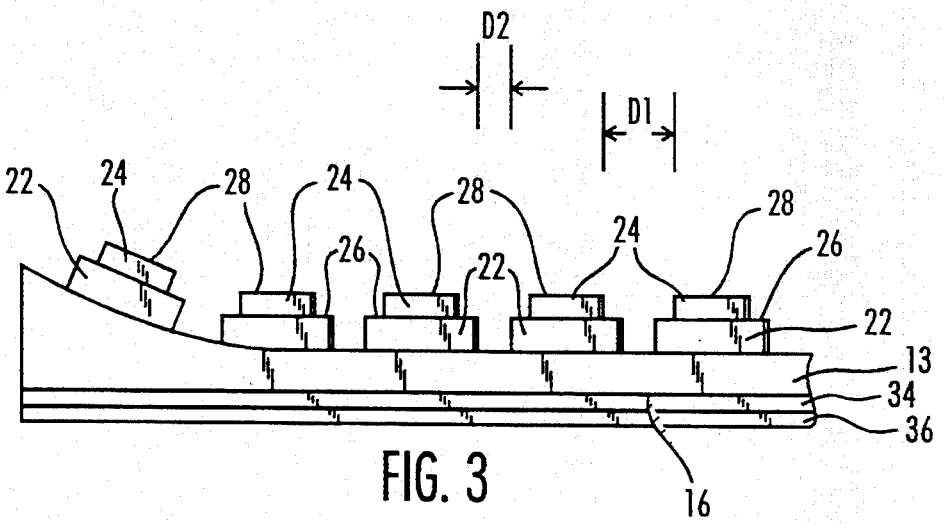
FIG. 3 is a side view of a portion of the surfboard padding in FIG. 1.

In the embodiment shown in FIGS. 1–3, each raised elements 21 comprises a first raised member 22 having a relatively large upper surface area and a second raised member 24 having a relatively small upper surface area extending from the upper surface of the first raised member. The first raised member 22 and the second raised member 24 each have an upper surface 26, and 28, respectively, substantially parallel to the upper surface 14 of the pad substrate 13 adjacent the raised member, and side surfaces 30, 32. The first raised members 22 extend from the top surfaces 14 of the multiple members 12 and the second raised members 24 extend from the upper surface of the first raised members 22. Generally, the upper surface area of diameter of the first raised member 22 is larger than the upper surface area or diameter of the second raised member 24. This results in a staggered or staircase type effect as shown in the figures.

The configuration of raised elements 21 are not limited to first and second raised members, but can comprise n-raised members of decreasing size, where n is any suitable number greater than one.

In some preferred embodiments, the number n of raised members forming the raised elements 21 on one pad member 12 (or on one portion of a pad member 12) may differ from the number n of raised members forming the raised elements 21 of another pad member 12 (or on another portion of the same pad member 12). For example, one pad member 12 of a pad system 10 may have raised elements 21 comprising first, second and third raised members and another pad member 12 of that same system 12 may have raised elements 21 comprising first, second, third and fourth raised members. This allows users greater versatility in the amount of traction that they may attain in selected areas of the surfboard.

The raised members 21, including the first raised elements 22 and the second raised elements 24, are preferably made from, but not limited to the same material from which the substrate 13 is made. Alternatively, other materials suitable to prevent slippage on the surface of the surfboard by a user's foot can be utilized.

Further, the raised members 22 and 24 can have a variety of cross sectional shapes (through a horizontal cross-section), including but not limited to, circles, triangles, ovals, hexagons, rectangles, other polygons or other suitable geometric patterns or shapes. Examples of raised members with such various cross sectional shapes are shown in FIGS. 2–5, which are perspective views of a portion of a pad member 12, according to preferred embodiments of the present invention.

In FIG. 2, the cross section (in a horizontal plane) of the first raised member 22 is square and the cross section (in a horizontal plane) of the second raised member 24 is square. As seen in FIG. 2, the upper surface area or diameter of the second raised member 24 is smaller than that of the first raised member 22. FIG. 3 depicts a side view of a portion of a pad member 12.

Figure 4:
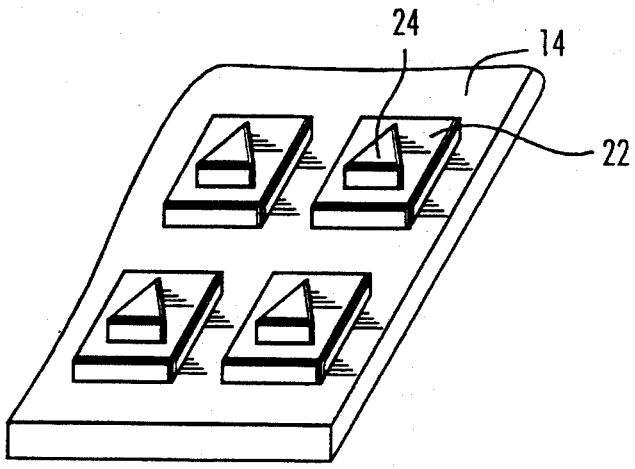
FIG. 4 is a perspective of a portion of surfboard padding according to another preferred embodiment of the invention.
Figure 5:
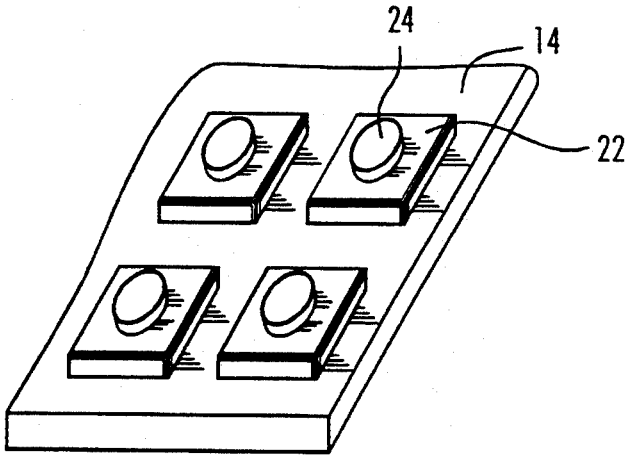
FIG. 5 is perspective of a portion of surfboard padding according to another preferred embodiment of the invention.

In FIG. 4, the first raised member 22 has a square cross section and the second raised member 24 has a triangular cross section. In FIG. 5, the first raised member 22 has a square cross section and the second raised member 24 has a circular cross section. As seen in FIGS. 4 and 5, the upper surface area or diameter of the second raised member 24 is smaller than the upper surface area or diameter of the first raised member 22.

In preferred embodiments, the substrate and the raised members are formed of a unitary pre-cut or preformed sheet of material. The contour shapes of the first raised members 22 and the second raised members 24 are preferably cut out (e.g., die cut), rather than press-formed on the substrate structure during manufacturing. This allows the side surfaces 30, 32 to meet the upper surface 14 of the substrate and the upper surfaces of the respective members 22 and 24 along a sharp edge (preferably 90°), thereby forming sharp corners which maximize traction and thus, the ability to inhibit foot slippage.

The top surface 14 of the substrate 13 is generally smooth. In further preferred embodiments, however, the top surface 14 is contoured. In other preferred embodiments, a logo or emblem or other indicia is provided on the top surface 14.

Figure 7:
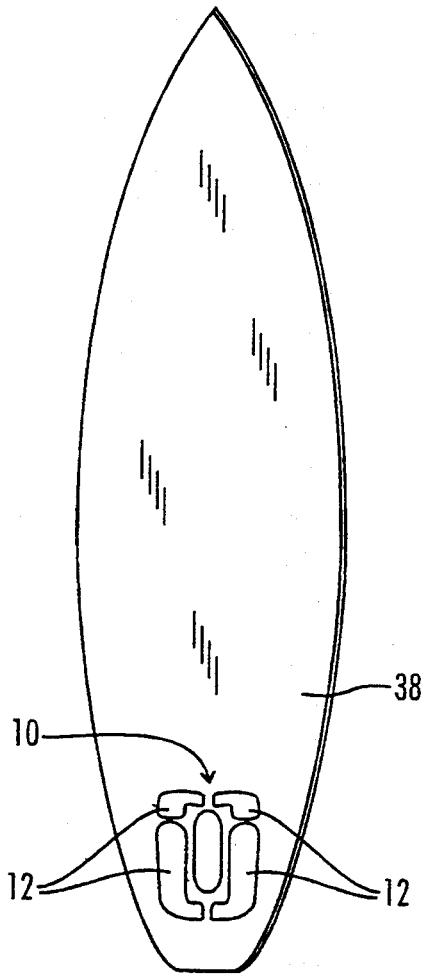
FIG. 7 is a top view of a surfboard having a padding system as shown in Figurel disposed thereon.

In preferred embodiments, the bottom surface 16 of each of the pad members 12 further has an adhesive coating 34 that is protected by a peel-away cover 36 prior to use. The adhesive coating readily adheres to the upper surface (or deck) of the surfboard. Once the peel-away cover is removed the adhesive surface is exposed and can be easily attached to the surfboard at any user-selectable location. In this manner, the user may place pad members 12 at locations which best accommodates the user's preferred foot placement. For example, the multiple pad members 12 shown in FIG. 1 may be arranged and adhered to the upper-surface or deck 38 of a surfboard as shown in FIG. 7. Of course, other arrangements (locations of the pad members) on the surfboard are also within the scope of the invention. Further embodiments may employ other suitable adhesives, glue, rivets, screws or other means for securing the members 12 to the surfboard.

The substrate 13 may be of uniform thickness over the entire pad member 12. Alternatively, portions of the substrate 13 may be thicker than other portions so as to provide one or more elevated sections of the substrate 13.

For example, the rearward directed end 20 of a pad member 12 has a thicker substrate portion than the rest of the pad member such that the upper surface 14 near the rearward end 20 is elevated relative to the upper surface 14 of the rest of the substrate. Typically, the members with elevated second ends 20 are adhered to the back, or tail section, of the surfboard. The elevated nature of the rearward end 20 provides the surfer with a tactile indication of the rear of the board and a greater control of the surfboard.

In operation, the padding system 10 is separated into its respective multiple pad members 12. Once separated, each individual pad member 12 is adhesively attached to the surfboard. If the padding system 10 is a single contiguous member, the pad member 12 will be adhered to the surfboard as a single unit.

Placement of the individual pad members 12 are at the discretion of the user. Typically, the user will strategically place the members 12 on the surfboard in the areas the user is most likely to occupy during surfing. Thus, the surfboard padding is not dependent upon the user's foot size, stride, width, or ability. Indeed, the pad members 12 can be placed relatively close together or far from each other. When the surfboard is in use, the user places his or her feet on the individual pad members 12 for improved traction and control of the surfboard.

Embodiments of the present invention provide better traction between the user's foot and the surfboard. The better traction allows for greater control of the surfboard. This increases the safety and enjoyment of the surfboard during use. Further, the ability to individually place each independent pad member 12 creates a unique product which allows each user to custom tailor the pad configuration to his or her own personal preference.

Each raised member 21 is composed of at least two raised elements having the appearance of being arranged one-on-the-other, in a stacked or stepped fashion, as discussed above. The lower elevation elements or elements, are larger in cross-section (along the horizontal plane) than the higher elevation element or elements. With this arrangement, better traction and water channelling is achieved than with prior single-element raised members. In particular, the higher elevation elements (e.g. elements 24 and FIGS. 1–6) are spaced apart from each other by a relatively large inter-element spacing (D1) (FIG. 3) relative to the inter-element spacing (D2) between lower elevation elements (e.g., elements 22 and FIGS. 1–6). This relatively large inter-element spacing between the upper surfaces of the higher elevation elements (the surfaces which directly contact the surfer's feet) provides better traction and water channelling features than closer spaced elements. Furthermore, because the higher elevation elements 24 are supported by larger, lower-elevation elements 22, the structural strength of the pad can be relatively great. That is, the forces applied by surfers' feet are not as likely to rip the multi-step elements from the substrate surface 14 than single diameter raised elements (raised elements having a constant cross-section). Thus, the multi-step raised elements allows the uppermost raised members to be spaced relatively far apart, yet structurally supported by the larger, lower elevation raised members.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. A non-slip padding for use with a surfboard comprising:

a padding system having at least one pad member with a top surface, a bottom surface, a first end and a second end; and at least one raised element extending from the top surface of the pad member, wherein the raised element comprises a first raised member extending from the top surface of the pad member and defining an upper surface and upper surface edges; and a second raised member extending from the upper surface of the first raised member and disposed within the upper surface edges of the first raised member.

2. A non-slip padding as claimed in claim 1 wherein the first raised member and the second raised member further comprise side surfaces substantially perpendicular to the upper surface of the first and second raised members.

3. A non-slip padding as claimed in claim 1, wherein each pad member has a substrate and wherein the portion of the substrate at the second end of at least one pad member is thicker than the rest of the substrate.

4. A non-slip padding as claimed in claim 1 wherein the first raised member is larger in diameter than the second raised member.

5. A non-slip padding as claimed in claim 1 wherein the pad members are made from flexible material.

6. A non-slip padding as claimed in claim 5 wherein the flexible material is foam rubber.

7. A non-slip padding as claimed in claim 5 wherein the flexible material is polyurethane.

8. A non-slip padding as claimed in claim 1, further comprising an adhesive disposed on the bottom surface of the pad member.

* * * * *